US010415584B2

(12) United States Patent
Shoji

(10) Patent No.: US 10,415,584 B2
(45) Date of Patent: Sep. 17, 2019

(54) IMPELLER AND FAN USING THE SAME

(71) Applicant: MINEBEA MITSUMI Inc., Nagano (JP)

(72) Inventor: Hirofumi Shoji, Novi, MI (US)

(73) Assignee: MINEBEA MITSUMI INC., Nagano (JP)

( * ) Notice: Subject to any disclaimer, the term of this patent is extended or adjusted under 35 U.S.C. 154(b) by 74 days.

(21) Appl. No.: 15/789,546

(22) Filed: Oct. 20, 2017

(65) Prior Publication Data

US 2019/0120244 A1 Apr. 25, 2019

(51) Int. Cl.

| | |
|---|---|
| ***F04D 29/44*** | (2006.01) |
| ***F04D 29/28*** | (2006.01) |
| ***F04D 29/66*** | (2006.01) |
| *F04D 25/06* | (2006.01) |

(52) U.S. Cl.

CPC ..... *F04D 29/282* (2013.01); *F04D 29/663* (2013.01); *F04D 29/667* (2013.01); *F04D 25/06* (2013.01)

(58) Field of Classification Search

CPC ..... F04D 29/30; F04D 29/281; F04D 29/444; F04D 29/162; F04D 29/324; F04D 29/544; F05D 2250/70

See application file for complete search history.

(56) References Cited

U.S. PATENT DOCUMENTS

| | | | | |
|---|---|---|---|---|
| 7,210,904 | B2 * | 5/2007 | Chandraker | F03B 3/02 415/206 |
| 7,597,541 | B2 * | 10/2009 | White | F04D 29/282 415/204 |
| 7,628,586 | B2 * | 12/2009 | Feher | B23P 15/006 415/170.1 |
| 8,475,131 | B2 * | 7/2013 | Shibata | F04D 29/284 416/182 |
| 8,562,297 | B2 | 10/2013 | Yen et al. | |
| 9,234,524 | B2 | 1/2016 | Shoji | |
| 9,528,374 | B2 * | 12/2016 | Ikeda | F04D 29/281 |
| 2010/0129224 | A1 * | 5/2010 | Shibata | F04D 29/284 416/182 |
| 2010/0329871 | A1 * | 12/2010 | Cahill | F04D 29/023 416/187 |
| 2014/0023501 | A1 * | 1/2014 | Ikeda | F04D 29/281 416/95 |

(Continued)

FOREIGN PATENT DOCUMENTS

| | | | |
|---|---|---|---|
| JP | 2940301 | B2 | 6/1999 |
| JP | 5634782 | B2 | 10/2014 |

*Primary Examiner* — Long T Tran

(74) *Attorney, Agent, or Firm* — Pearne & Gordon LLP

(57) ABSTRACT

An impeller for a centrifugal fan includes a base plate, a ring-shaped shroud, a tubular inlet port connecting the circular inlet of the shroud and the base plate, and a plurality of blades annularly disposed around the tubular inlet port at regular intervals. Each of the blades includes a pressurized surface, a suction surface, a leading edge, and a trailing edge. When viewed in a direction parallel to the rotation axis of the impeller, a distance between the pressurized surface and the suction surface of each of the blades becomes increasingly larger starting from the leading edge of the pressurized surface and extending toward the trailing edge of each of the blades at a predetermined height.

22 Claims, 11 Drawing Sheets

(56) References Cited

U.S. PATENT DOCUMENTS

| | | | | |
|---|---|---|---|---|
| 2014/0093366 | A1* | 4/2014 | Otsuka | F04D 29/281<br>415/206 |
| 2015/0118037 | A1* | 4/2015 | Otsuka | F04D 25/0613<br>415/206 |
| 2015/0308452 | A1* | 10/2015 | Son | B23K 11/0026<br>416/182 |
| 2015/0322952 | A1* | 11/2015 | Bertoneri | F04D 31/00<br>415/1 |
| 2016/0252101 | A1* | 9/2016 | Rubino | F04D 29/284<br>415/211.2 |

* cited by examiner

IMPELLER AND FAN USING THE SAME

BACKGROUND

Field

Embodiments of the present disclosure relate to an impeller for a centrifugal fan or a diagonal fan, and to a centrifugal fan or a diagonal fan including the impeller. More specifically, embodiments of the present disclosure relate to a structure and configuration of impeller blades for improving the efficiency and the acoustic level of the impeller.

Description of Related Art

High performance centrifugal fans are used in variety of industrial and laboratory applications such as, for example, heating, ventilating, and cooling systems. The performance and desirability of the fans are measured by the fan efficiency and acoustic level produced during operation. The improvement of fan efficiency will reduce the energy needed to operate the fan and/or increase output airflow and pressure.

BRIEF SUMMARY

The following summary presents a simplified summary in order to provide a basic understanding of some aspects of the devices discussed herein. This summary is not an extensive overview of the devices discussed herein. It is not intended to identify critical elements or to delineate the scope of such devices. Its sole purpose is to present some concepts in a simplified form as a prelude to the more detailed description that is presented later.

Fan efficiency is affected by a number of factors. For example, the efficiency of a drive mechanism such as a motor and the revolving speed of the motor and blades may impact the fan energy efficiency. Present disclosure provides impellers for centrifugal fans or diagonal fans with improved fan efficiency and low acoustic noise by delaying separation of fluid flow from the surface of the impeller blades.

In accordance with one aspect of the present disclosure, provided is an impeller for a centrifugal fan or a diagonal fan. The impeller includes a base plate, a ring-shaped shroud located above the base plate at a predetermined distance, the shroud comprising a circular inlet in the center of the ring-shape, a tubular inlet port connecting the circular inlet of the shroud and the base plate, a plurality of blades annularly disposed around the tubular inlet port at regular intervals between the shroud and the base plate, and connecting the shroud to the base plate, and a flow passage between two of the plurality of the blades that are adjacent to each other in a circumferential direction of the ring-shaped shroud. The flow passage is defined by the base plate, the ring-shaped shroud, and the two of the plurality of the blades. The flow passage defines a fluid outlet from the tubular inlet port through a trailing edge of the plurality of the blades to an outer circumference of the ring-shaped shroud.

Each of the plurality of the blades includes a pressurized surface (or a windward surface) extending from a leading edge (or an inner edge or an inner end) to a trailing edge (or an outer edge) of each blade connecting the shroud and the base plate. A cross-section of the pressurized surface has a curved shape expanding toward the pressurized side of each of the blade when viewed in a direction parallel to a rotation axis of the impeller, a suction surface (or a leeward surface) extending from the leading edge to the trailing edge of each blade connecting the shroud and the base plate. A cross-section of the suction surface has a curved shape expanding toward the pressurized side of each of the blades when viewed in a direction parallel to the rotation axis of the impeller.

When viewed in a direction parallel to the rotation axis of the impeller, a distance between the pressurized surface and the suction surface of each of the plurality of the blades becomes increasingly larger starting at a predetermined distance from the leading edge of the blade and extending toward the trailing edge of the blade.

In accordance with one aspect of the present disclosure, provided is a centrifugal fan that includes a drive mechanism such as a motor and an impeller of the present disclosure.

DETAILED DESCRIPTION

Figure 1:
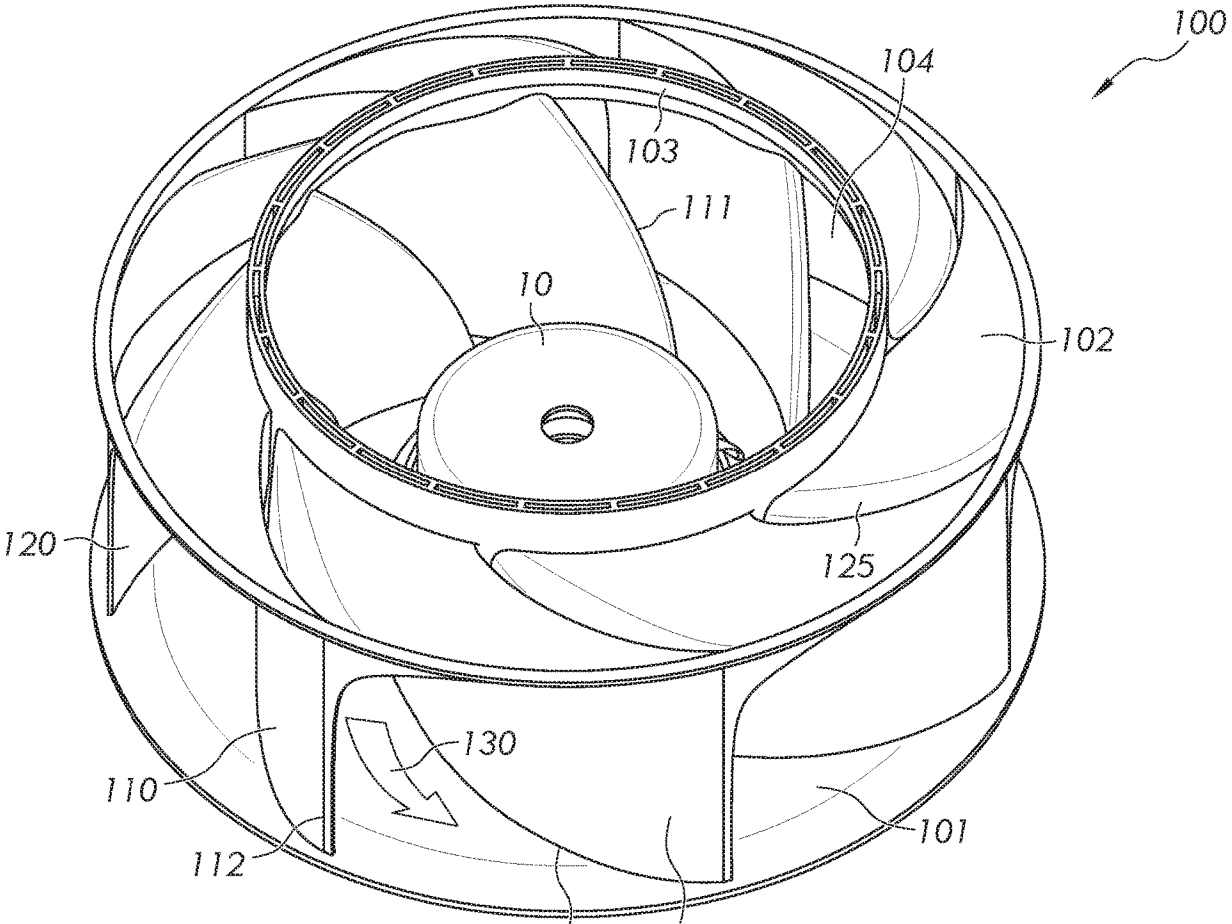
FIG. 1 is a perspective view of an impeller and a motor for a centrifugal fan according to one embodiment of the present disclosure.

Many of the efficiency factors discussed above are taken into account when issues of fan efficiency and acoustic noise are investigated. Primarily, impeller structures with unique blade structures are investigated. For example, centrifugal fans are categorized by their blades' shapes into the following categories; 1) radial fans with straight blades, 2) radial fans with forward-curved blades, and 3) radial fans with backward-curved blades.

Other structures such as, for example, blade profiles with specific thickness distribution and hollow blades are also investigated in order to improve manufacturability and productivity.

A plurality of blades arranged between a shroud and a base plate dominates aerodynamic characteristics of the backward swept type of a centrifugal fans' structure. When an impeller rotates, the pressurized surface creates a high fluid pressure, and the suction surface creates lower fluid pressure. As the pressure gradient across the fan's medium increases, flow separation of the fluid from the surface of the blade starts at the suction surface. In order to improve aerodynamic efficiency, e.g., the ratio of air-power to input power (to rotate an impeller), for centrifugal-type of fans with the backward swept blade, managing and delaying the flow separations along the blade surfaces was investigated.

The peak aerodynamic efficiency of a fan occurs when the flow separations from the surface of the blades are about to develop along the surfaces of the suction surface toward the shroud (in the vicinity of the uppermost end of each blade) due to a pressure gradient developed across the impeller medium. By implementing blade geometry, more specifically, cross-sectional profiles which define general construction of the blade, the flow separation can be managed and delayed until a higher pressure gradient is generated across the medium. More specifically, when the blade surface geometry at its upper end on the suction side (or the leeward side) is appropriately controlled or manipulated, the flow separation can be delayed. As a result, the aerodynamic performance in both of the efficiency and acoustic noise can be significantly improved.

Embodiments of the present disclosure relate to structures and orientation of impeller blades for improving the P-Q characteristics and energy efficiency of centrifugal fans, and a method of delaying flow separation of an impeller for a centrifugal fan or a diagonal fan.

The impeller of the present disclosure has a plurality of blades. Each blade has a pressurized surface and a suction surface with a unique shape. For example, each blade can have a curved suction surface gradually separated at an increasing amount from the pressurized surface at a predetermined distance from a leading edge toward a trailing edge of each of the blades, and at a predetermined height from a base plate of the impeller toward an uppermost end of the blade. Example applications of the impellers of the present disclosure, for example, are industrial applications, telecom centers, and cloud centers.

The present disclosure will now be described with reference to the drawings, wherein like reference numerals are used to refer to like elements throughout. It is to be appreciated that the various drawings are not necessarily drawn to scale from one figure to another nor inside a given figure, and in particular that the size of the components are arbitrarily drawn for facilitating the understanding of the drawings. In the following description, for purposes of explanation, numerous specific details are set forth in order to provide a thorough understanding of the present disclosure. It may be evident, however, that the present disclosure can be practiced without these specific details. Additionally, other embodiments of the disclosure are possible and the disclosure is capable of being practiced and carried out in ways other than as described. The terminology and phraseology used in describing the disclosure is employed for the purpose of promoting an understanding of the disclosure and should not be taken as limiting.

Figure 7:
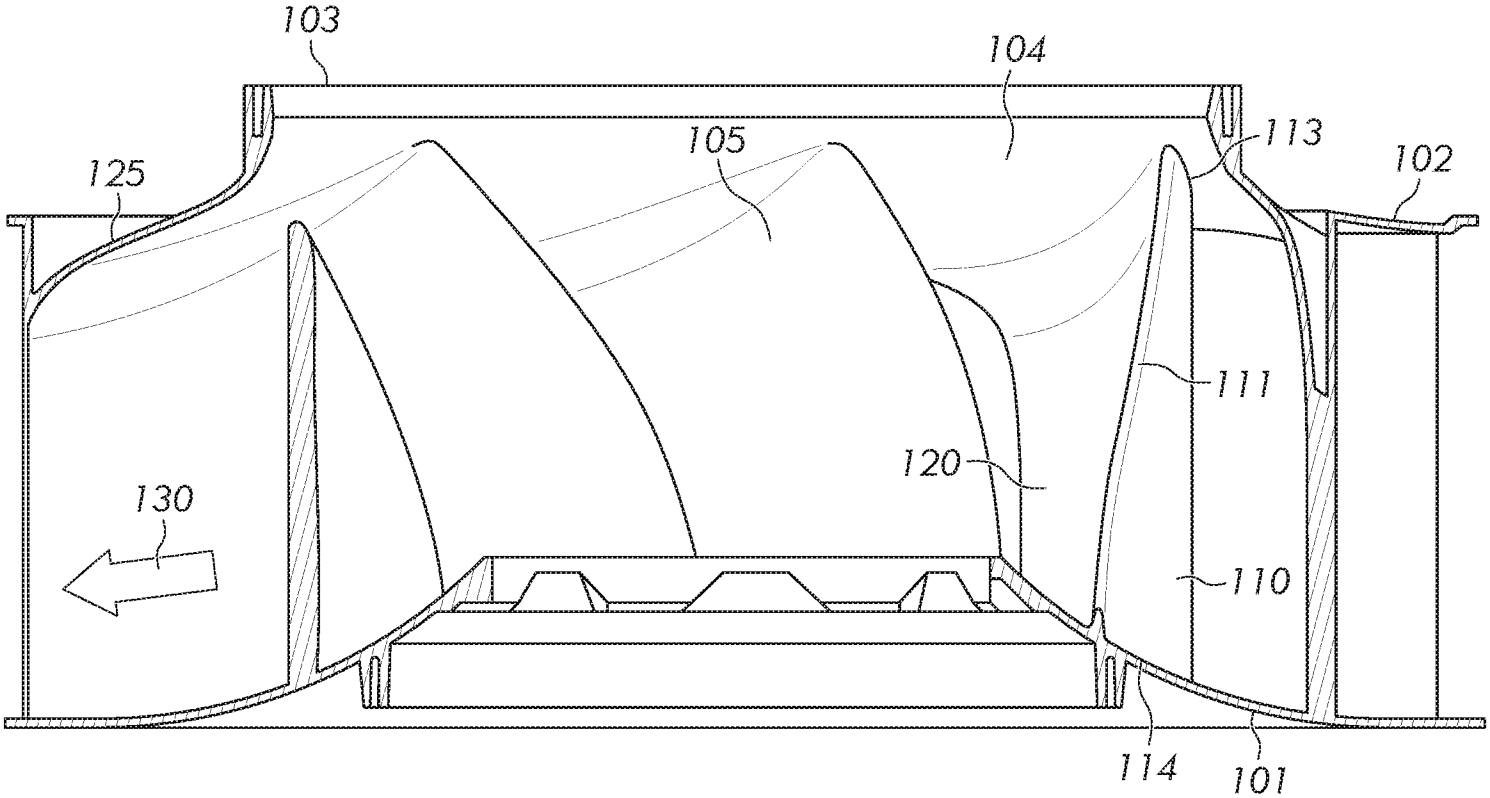
FIG. 7 is a cross-sectional view of the impeller according to one embodiment of the present disclosure, taken in a plane perpendicular to the base plate of the impeller and at line F-F of FIG. 2 of the present application.

FIG. 1 illustrates a perspective view of an impeller 100 according to one embodiment of the present disclosure. The impeller 100 is a motorized impeller provided with a motor 10 as an example driving mechanism. For simplicity and clarity, the motor 10 is shown in FIG. 1 and is removed in some of the remaining drawings. The impeller 100 includes a base plate 101 and a ring-shaped shroud 102 provided above the base plate 101. The shroud 102 is distant from the base plate 101 at a predetermined distance. The shroud 102 includes a circular inlet 103 in the center of the ring-shape and a tubular inlet port 104 connecting the circular inlet 103 of the shroud 102 and the base plate 101. It is further contemplated that the circular inlet 103 can include one or more pockets to accept weights to rotationally balance the impeller. Additionally, as shown in FIG. 7, the base plate 101 can include a relatively flat outer geometry connected to a cone-shaped inner geometry, although other geometries are contemplated.

The shroud 102 can be constituted by a back surface 125 of the suction surface 120 of the plurality of the blades 105. More specifically, the uppermost end 113 of each of the plurality of the blades 105 can include an uppermost end 113 of the blade 105 and the back surface 125 of the suction surface 120. With this configuration, the impeller 100 can be manufactured, for example, by implementing with a simpler or casting structure without in need of its complexity excessively. This can increase the efficiency of the manufacturing process and significantly reduce the manufacturing cost.

In one embodiment, the blades 105 are partially or completely hollow. In another embodiment, the hollow gaps can be partially or completely filled by a suitable material, such as resin or metal (which may or may not be according to the material of the blades 105), or the blades 105 can be manufactured as solid components. Existence of the blade hollow gaps or interior does not affect performance of the impeller 100. The performance of the impeller 100 with the hollow gaps, the performance of the impeller 100 with filled gaps, and the performance of the impeller 100 with solid blades are all substantially or completely the same.

Figure 9:
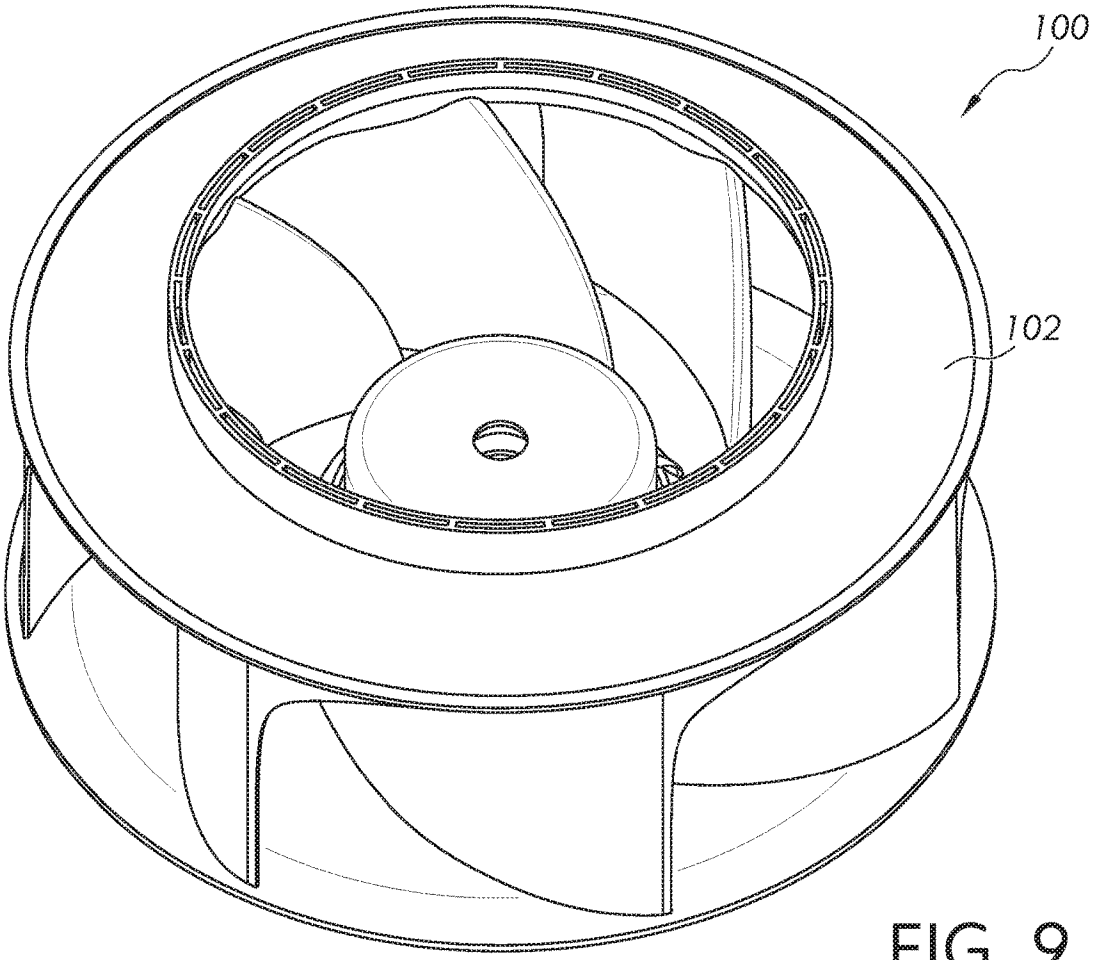
FIG. 9 is a perspective view of an impeller for a centrifugal fan according to one embodiment of the present disclosure that includes a shroud with a ring-shaped flat surface.

In addition or alternatively, the shroud 102 of another embodiment can exclude a ring-shaped edge surrounding the end of the shroud 102. In addition or alternatively the shroud 102 of another embodiment can include a ring-shaped uniform flat surface as often seen in standard impellers. Such structure is shown in FIG. 9 of the present disclosure.

Turning back to FIGS. 1-2, the impeller 100 includes the plurality of blades 105 annularly disposed around the tubular inlet port 104 at regular intervals between the base plate 101 and the shroud 102. A flow passage 130 for fluid is defined by a construction of the base plate 101, the shroud, and two of the blades 105 that are adjacent to each other in a circumferential direction of the impeller 100. The flow passage 130 defines an outlet of fluid from the tubular inlet port 104 through a trailing edge 112 of the blades 105 to an outer circumference of the impeller 100.

Each blade 105 has a pressurized surface 110, i.e., an upstream side of the blade 105 in the rotational direction. The pressurized surface 110 extends from a leading edge 111 to a trailing edge 112 of each of the blades 105. The pressurized surface 110 of each of the blades 105 connects the shroud 102 and the base plate 101. A cross-section of the pressurized surface 110 has a curved shape expanding (or protruding) toward the pressurized side (or the windward side) of each of the blades 105 when viewed in a direction parallel to the rotation axis (shown as line Z in FIG. 2 of the present disclosure) of the impeller 100.

Each blade 105 has a suction surface 120, i.e., a downstream side of the blade 105. The suction surface 120 extends from the leading edge 111 to the trailing edge 112 of each of the blades 105. The suction surface 120 of each of the blades 105 connects the shroud 102 and the base plate 101. A cross-section of the suction surface 120 has a curved shape expanding (or protruding) toward the pressurized side of each of the blades 105 when viewed in a direction parallel to the rotation axis of the impeller 100. The pressurized surface 110 and the suction surface 120 are split by the leading edge 111.

Figure 2:
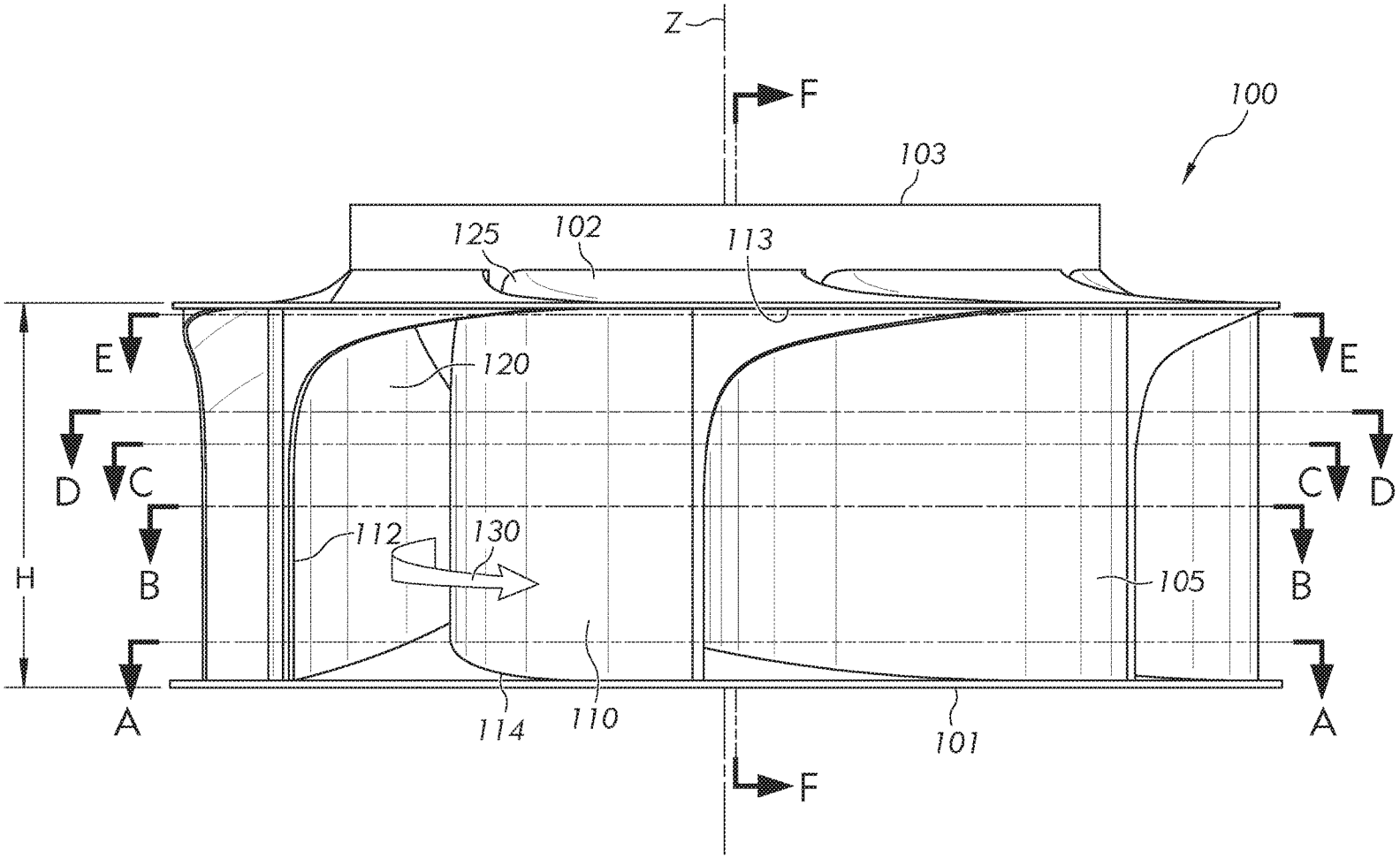
FIG. 2 is a side view of the impeller according to one embodiment of the present disclosure.

FIG. 2 illustrates a side view of the impeller 100 according to one embodiment of the present disclosure. The blade height, H, at the trailing edge 112 of the pressurized surface 110 can be defined as a distance between the base plate 101 and the shroud 102. As can be appreciated by one of skill in the art, the actual dimensions of the blade can vary according to the geometry and size of the impeller. Thus, although provided as examples, the dimensions discussed herein are not intended to be a limitation upon the invention. The overall height of the impeller can be 60 mm to 150 mm, for example; common sizes are 69 mm, 99 mm, 120 mm, or 127 mm. The blade height, H, can be 40 mm to 110 mm; common sizes are 55 mm, 75 mm, or 95 mm. The outermost diameter of the impeller 100 can be 120 mm to 700 mm, for example; common sizes are 175 mm, 190 mm, 220 mm, 225 mm, 250 mm, 280 mm, 294 mm, 310 mm, 335 mm, etc. The diameter of the circular inlet 103 can be 80 mm to 300 mm, for example; common sizes are 115 mm or 131 mm.

Figure 3:
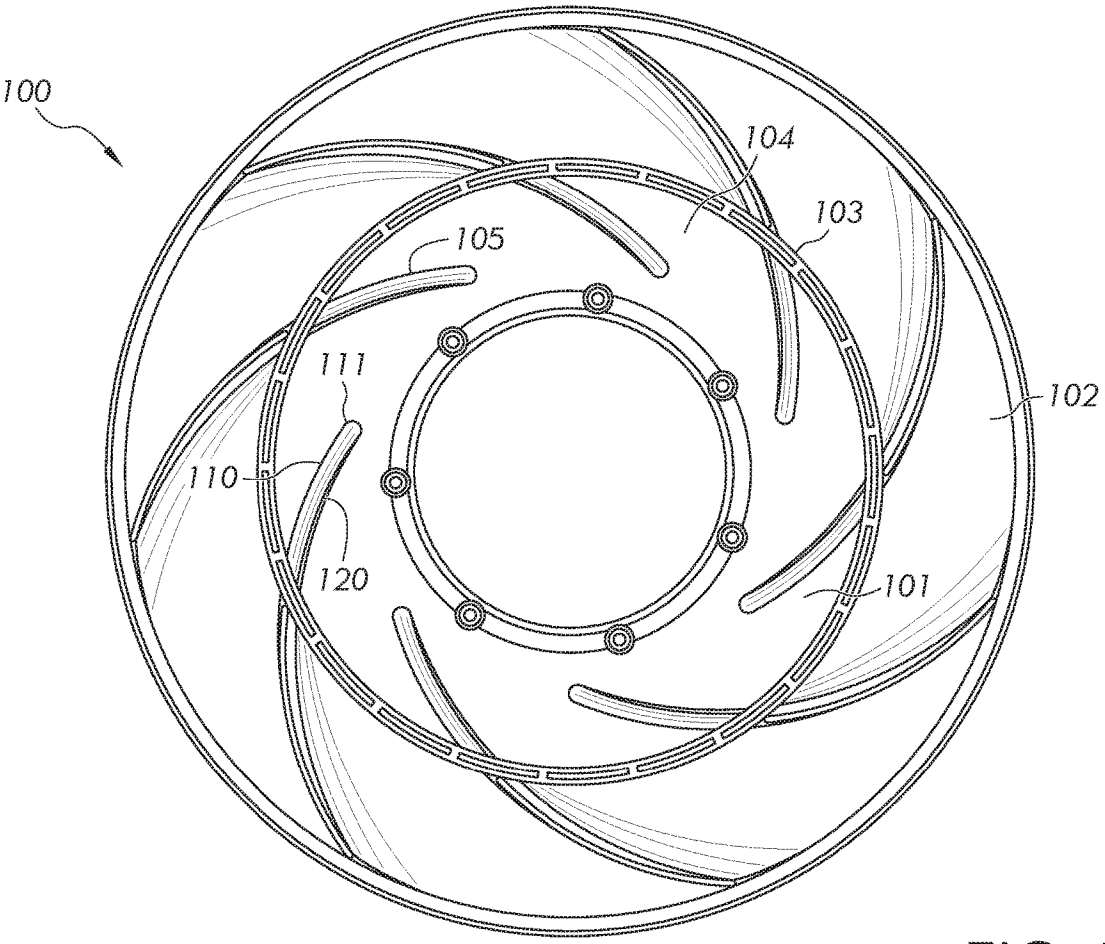
FIG. 3 is a top view of the impeller according to one embodiment of the present disclosure.

FIG. 3 illustrates a top view of the impeller 100 according to one embodiment of the present disclosure. When viewed in a direction parallel to the rotation axis of the impeller 100, the curved shape of the cross-section of the pressurized surface 110 is substantially uniform between the uppermost end 113 and the lowermost end 114 of the blade 105.

Figure 4:
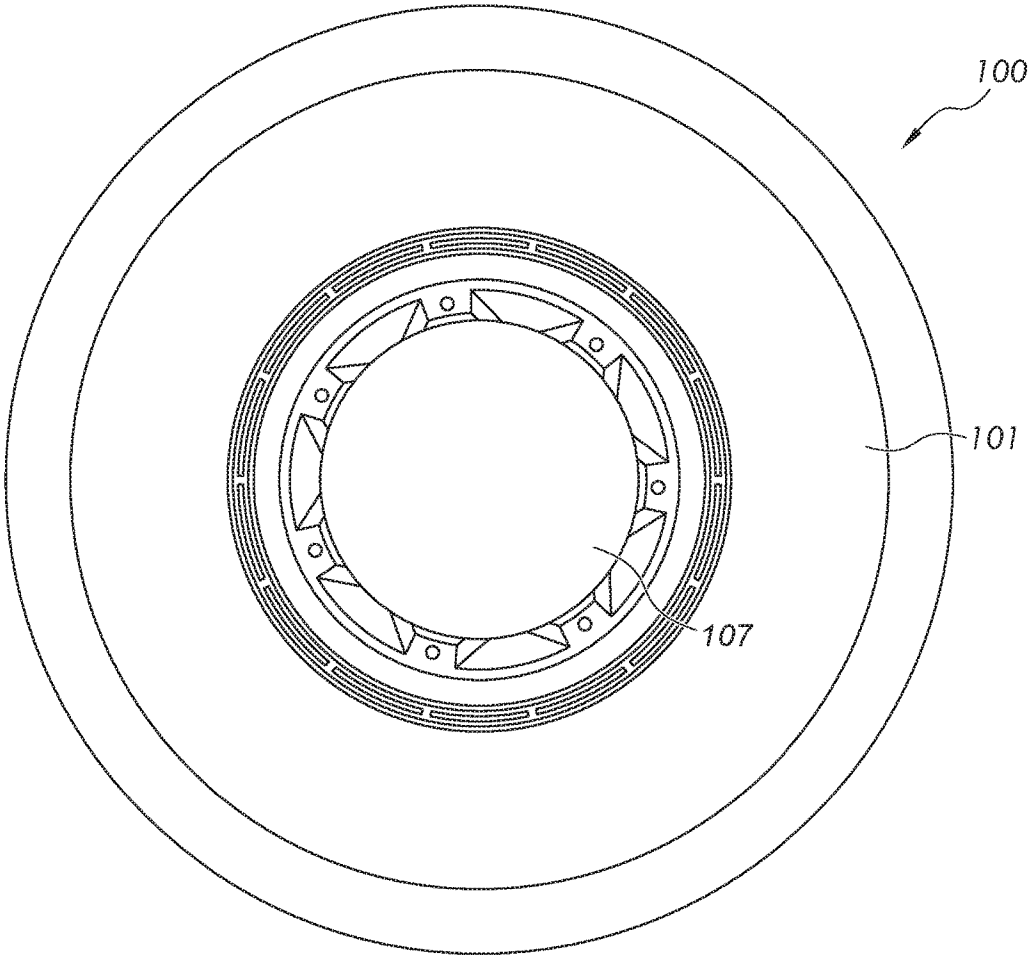
FIG. 4 is a bottom view of the impeller according to one embodiment of the present disclosure.

FIG. 4 illustrates a bottom view of the impeller 100 according to one embodiment of the present disclosure. The rear side of the impeller 100 includes the base plate 101 and the motor mount 107 of the impeller 100 to which the motor 10 is connected by suitable mechanical fasteners. In one example, the motor mount 107 can include a plurality of bosses to receive screws, bolts, or the like. In another example, the motor mount 107 can include anti-rotation geometry that is form-fit to the motor 10. Additionally, it is contemplated that a circular ring about the motor mount 107 can include one or more pockets to accept weights to rotationally balance the impeller.

Figure 5A:
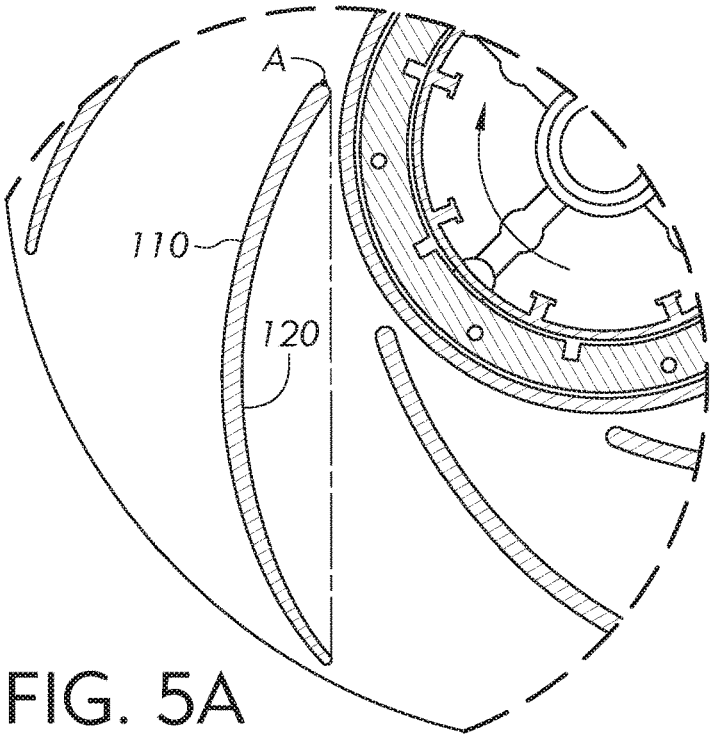
FIG. 5A is an enlarged cross-sectional view of a part of the impeller according to one embodiment of the present disclosure, taken in a plane parallel to the base plate of the impeller at a height close to the lowermost end of the blade.
Figure 5B:
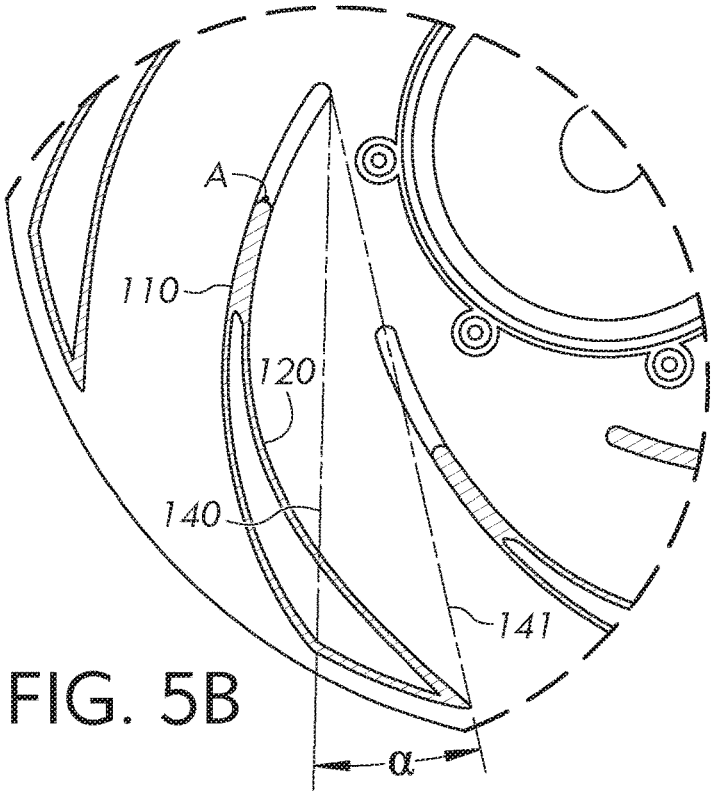
FIG. 5B is an enlarged cross-sectional view of the impeller according to one embodiment of the present disclosure, taken in a plane parallel to the base plate of the impeller vertically above FIG. 5A at another height closer to the uppermost end of the blade.

Referring now to FIGS. 5A and 5B, the structure of the blades 105 of the impeller 100 of the present disclosure is explained. The plurality of blades 105 of the impeller 100 according to one embodiment of the present disclosure each has a unique shape and structure that can be described as follows. When viewed in a direction parallel to the rotation axis of the impeller 100, i.e., in the direction as shown in FIGS. 6A-6E, the cross-sectional profile of the plurality of blades 105 varies from the base plate 101 to the shroud 102 along the rotation axis of the impeller 100. The cross-sectional profile of the blade 105 can be distinguished and constructed by two segments split by at a point of the leading edge 111 shown as point "A" in FIGS. 5A and 5B. One segment of the profiles can be found in the pressurized surface 110 and another one found in the suction surface 120 of the blade 105 split by the leading edge 111. At the pressurized surface 110, the section profile remains substantially constant along the axis of rotation between the lowermost end 114 and the uppermost end 113 of the blade 105, while the cross-sectional profile at the suction surface 120 of the blade 105 varies along the axis of rotation, in one example, starting at about 50% of the total height of the blade 105.

More specifically, at the lowermost end 114 of the blade 105, the profile starts possessing a shape nearly identical to the curvatures of the cross-sectional profile of the pressurized surface 110 with concentric thickness ratios to the cross-sectional profile of the pressurized surface 110 of 1-3% of the chord length. At the trailing edge of the cross-sectional profile of the suction surface 120, it gradually expands toward the next blade downstream side of the direction of rotation as the cross-sectional profile moves up along the axis of the rotation. As shown as point "A" in FIG. 5A, the suction surface 120 can start separating from the pressurized surface 110 at the leading edge 111 of the blade 105. As shown as point "A" in FIG. 5B, the suction surface 120 can start separating from the pressurized surface 110 at a predetermined distance from the leading edge 111 of the blade 105. The predetermined distance can be about 0-30% of the chord length 141 of the suction surface 120.

FIGS. 6A-6E illustrate cross-sectional views of the impeller 100 according to one embodiment of the present disclosure, taken in a plane parallel to the base plate 101 of the impeller 100 at different heights from the base plate 101. The progression of figures illustrates that a distance between the pressurized surface 110 and the suction surface 120 of each of the plurality of the blades 105 becomes increasingly larger, as each blade progresses from the lower base plate towards the upper shroud. Each cross-section profile is connected each other with a continuously smooth curved surface.

Figure 6A:
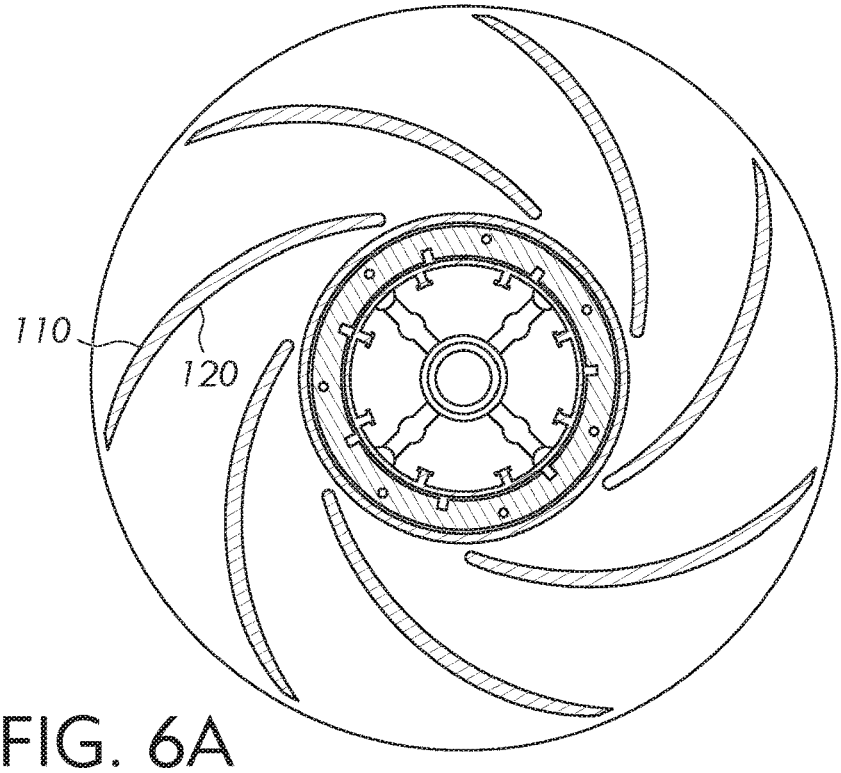
FIG. 6A is a cross-sectional view of the impeller according to one embodiment of the present disclosure, taken in a plane parallel to the base plate of the impeller and at about 10% of the total height of the impeller from the base plate at line A-A of FIG. 2 of the present application.

FIG. 6A illustrates a cross-sectional view of the impeller 100 according to one embodiment of the present disclosure, taken in a plane parallel to the base plate 101 of the impeller 100 and at 10% of the total height of the blade 105 at line A-A of FIG. 3 of the present application. In order to avoid aerodynamic drag, a thickness of the blades 105 can be minimal in the vicinity of the lower end of the pressurized surface 110 and the suction surface 120. Therefore, there is no hollow gap (or a minimal hollow gap) provided between the pressurized surface 110 and the suction surface 120 at the lower end close to the base plate 101.

Figure 6B:
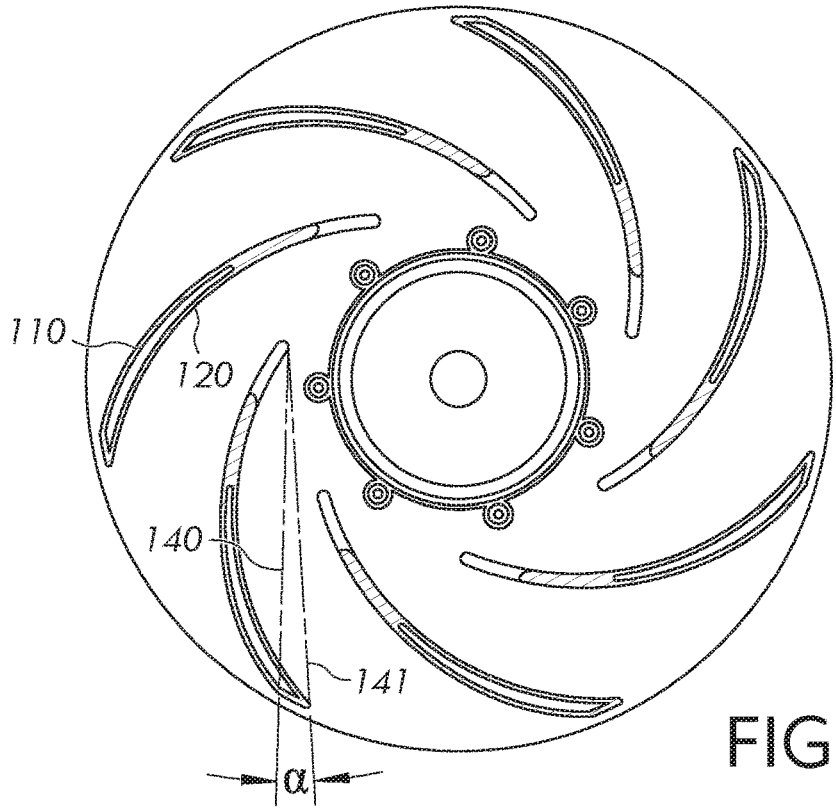
FIG. 6B is a cross-sectional view of the impeller according to one embodiment of the present disclosure, taken in a plane parallel to the base plate of the impeller and at about 50% of the total height of the impeller from the base plate at line B-B of FIG. 2 of the present application.

FIG. 6B illustrates a cross-sectional view of the impeller 100 according to one embodiment of the present disclosure, taken in a plane parallel to the base plate 101 of the impeller 100 and at 50% of the total height of the blade 105 at line B-B of FIG. 3 of the present application. At the height around 50% of the blade 105, the suction surface 120 starts separating from the pressurized surface 110. It is to be understood that the particular height at which the suction surface 120 starts separating from the pressurized surface 110 can change depending upon the impeller structure. In the case of the example impeller shown in the figures, if the suction surface 120 starts separating from the pressurized surface 110 at a height lower than the 50% from the lowermost end 114 of the blade 105, an amount of the fluid flow maybe decreased and the energy efficiency may also be decreased. However, it is understood that the particular height at which the suction surface 120 starts separating from the pressurized surface 110 could be more or less than 50% of the total height of the impeller 100 depending upon the geometry of the elements and desired performance of the fan. The suction surface 120 is separated away from the pressurized surface 110 at the trailing edge 112 of the blade 105 by about 0-5 degree of the angle (a) between the chord 140 of the pressurized surface 110 and the chord 141 of the suction surface 120 with a 7-blade impeller. The angle varies depending on the number of the blades provided in the impeller.

When viewed in a direction parallel to the rotation axis of the impeller 100, curvature radiuses of the cross-section of the pressurized surface 110 can be substantially the same between the uppermost end 113 and the lowermost end 114 of the blade 105. In other words, the pressurized surface 110 has one or more different curvature radiuses on its surface, and the curvature radiuses of the cross-section of the pressurized surface 110 can be substantially the same between the uppermost end 113 and the lowermost end 114 of the blade 105, but any of the curvature radiuses of the pressurized surface 110 at any height of the blade 105 between the uppermost end 113 and the lowermost end 114 of the blade 105 can deviate about less than 10% from the curvature radiuses of the pressurized surface 110 at the lowermost end 114 of the blade 105. An example curvature radius of the pressurized surface 110 is shown as R1 in FIG. 6E. On the other hand, curvature radiuses of a part of the cross-section of the suction surface 120 becomes smaller at a predetermined distance (1-30% of the chord length of the suction surface) from the leading edge 111 of the blade 105 at the predetermined height of the blade 105, and the suction surface 120 gradually separates from the pressurized surface 110 from the leading edge 111 toward the trailing edge 112 at the predetermined height of the blade 105. The predetermined height can be 50%-100% of the total height of the blade 105. An Example curvature radius of the part of the suction surface 120 that becomes smaller is shown as R2 in FIG. 6E. Therefore, the gap between the pressurized surface 110 and the suction surface 120 becomes larger toward the trailing edge 112 of the blade 105 at 50%-100% of the blade 105. The suction surface 120 can have one or more curvature radiuses on its surface. The curvature radiuses of the suction surface 120 increase toward the trailing edge 112 with a gentle curve. As an example, one of the larger curvature radiuses on the suction surface 120 near the trailing edge 112 is shown as R3 in FIG. 6E.

Figure 6C:
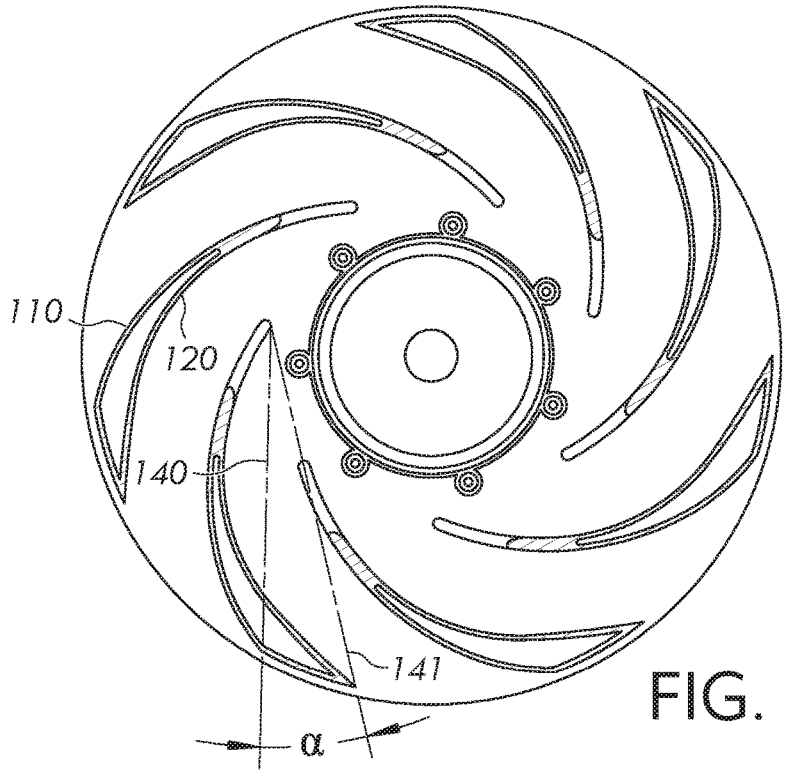
FIG. 6C is a cross-sectional view of the impeller according to one embodiment of the present disclosure, taken in a plane parallel to the base plate of the impeller and at about 70% of the total height of the impeller from the base plate at line C-C of FIG. 2 of the present application.

FIG. 6C illustrates a cross-sectional view of the impeller 100 according to one embodiment of the present disclosure, taken in a plane parallel to the base plate 101 of the impeller 100 and at 70% of the total height of the blade 105 at line C-C of FIG. 3 of the present application. The suction surface 120 is separated away from the pressurized surface 110 at the trailing edge 112 of the blade 105 by about 5-30 degree of the angle between the chord 140 of the pressurized surface 110 and the chord 141 of the suction surface 120 with a 7-blade impeller. The angle varies depending on the number of the blades provided in the impeller.

Figure 6D:
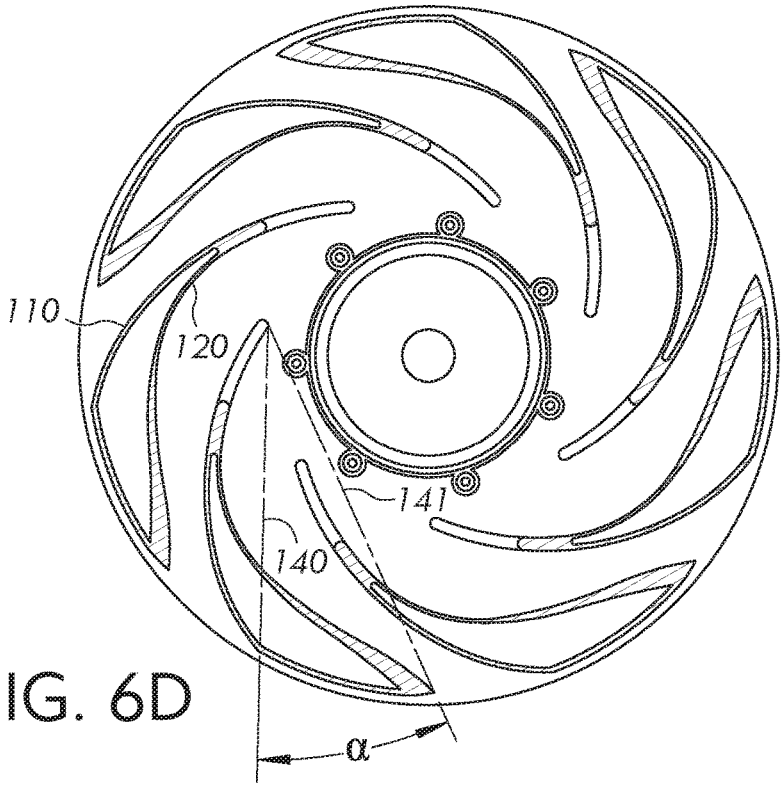
FIG. 6D is a cross-sectional view of the impeller according to one embodiment of the present disclosure, taken in a plane parallel to the base plate of the impeller and at about 80% of the total height of the impeller from the base plate at line D-D of FIG. 2 of the present application.

FIG. 6D illustrates a cross-sectional view of the impeller 100 according to one embodiment of the present disclosure, taken in a plane parallel to the base plate 101 of the impeller 100 and at 80% of the total height of the blade 105 at line D-D of FIG. 3 of the present application. The suction surface 120 is separated away from the pressurized surface 110 at the trailing edge 112 of the blade 105 by about 10-50 degree of the angle between the chord 140 of the pressurized surface 110 and the chord 141 of the suction surface 120 with a 7-blade impeller. The angle varies depending on the number of the blades provided in the impeller.

Figure 6E:
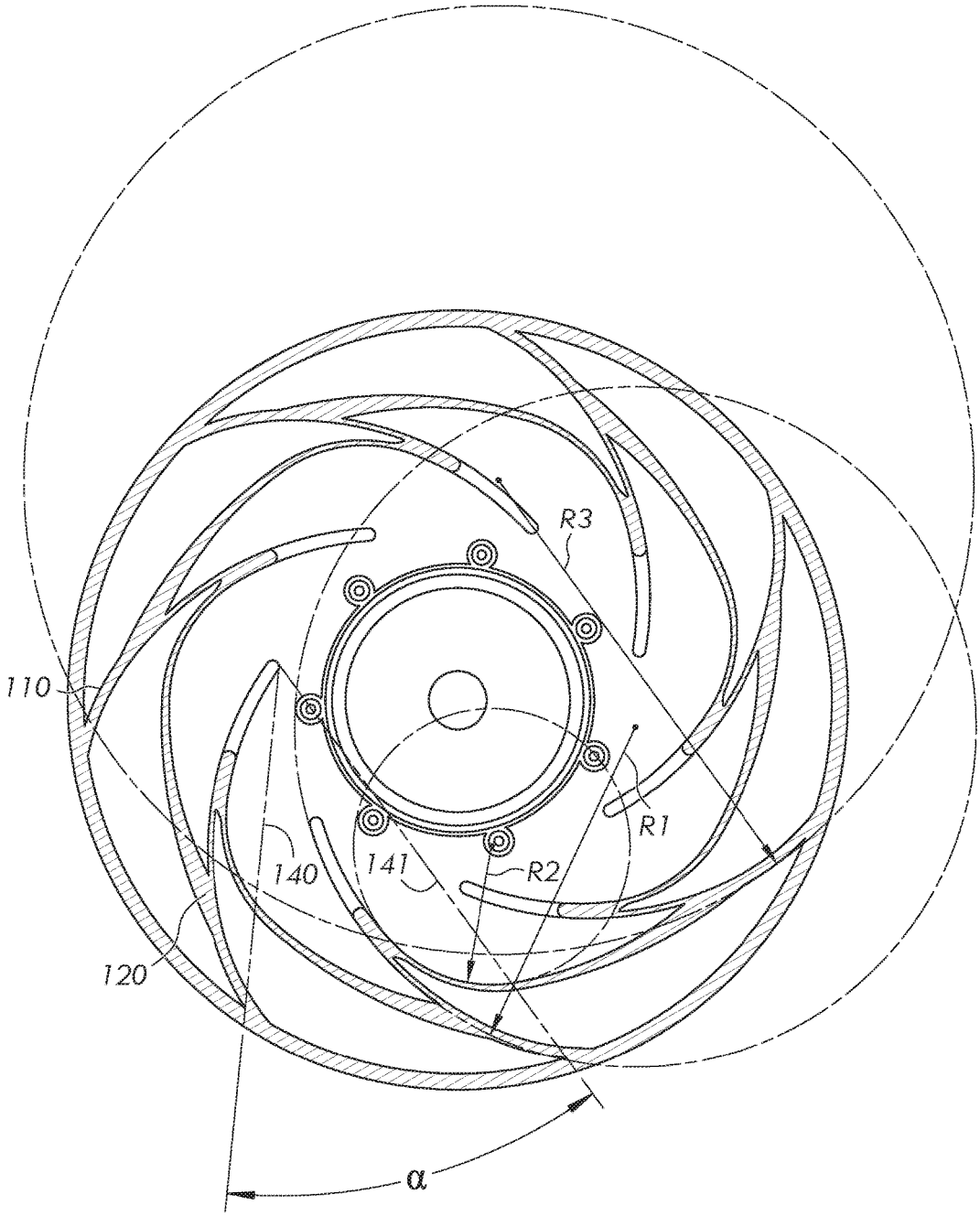
FIG. 6E is a cross-sectional view of the impeller according to one embodiment of the present disclosure, taken in a plane parallel to the base plate of the impeller and at about 90% of the total height of the impeller from the base plate at line E-E of FIG. 2 of the present application.

FIG. 6E illustrates a cross-sectional view of the impeller 100 according to one embodiment of the present disclosure, taken in a plane parallel to the base plate 101 of the impeller 100 and at 90% of the total height of the blade 105 at line E-E of FIG. 3 of the present application. The suction surface 120 is separated away from the pressurized surface 110 at the trailing edge 112 of the blade 105 by about 40-70 degree of the angle between the chord 140 of the pressurized surface 110 and the chord 141 of the suction surface 120 with a 7-blade impeller. The angle varies depending on the number of the blades provided in the impeller. At the uppermost end 113, the suction surface 120 is connected to an uppermost end 113 of another pressurized surface 110 that is adjacent to the suction surface 120 in the downstream side of the direction of the rotation of the impeller 100. The uppermost ends 113 may further be blended into the ring-shaped shroud 102. At the uppermost end 113 of the blade 105, the total length of the chord 141 can be 160% of the total length of the chord 140 with a 7-blade impeller. The percentage varies depending on the number of the blades provided in the impeller.

When viewed in a direction parallel to the rotation axis of the impeller 100, a smallest curvature radius of the suction surface 120 from the leading edge 111 can be at between 1-30% of the total length of the chord 141 from the leading edge 111 of the blade 105. An example smallest curvature radius of the suction surface 120 is shown as R2 in FIG. 6E. The smallest curvature radius means a radius of a curvature of the most curved portion of the suction surface 120 or a portion that has a smallest curvature radius with the center of radius located toward a downstream direction of its rotation on the suction surface 120 at a predetermined height, and is the curvature radius of the suction surface 120 located at a predetermined distance from the leading edge 111 of the suction surface 120. The predetermined distance can be 1 to 30% of the total length of the chord 141 from the leading edge 111 of the blade 105. The curvature radius of the suction surface 120 increases toward the trailing edge 112 with a gentle curve. One of the larger curvature radiuses on the suction surface 120 near the trailing edge 112 is shown as R3 in FIG. 6E.

With the configuration of the blades 105 of the impeller 100 according to one embodiment of the present disclosure shown in FIGS. 6A-6E, flow separation of the fluid from the blade surfaces can be delayed, and the aerodynamic efficiency can be improved. One method of delaying the separation of the fluid includes rotating the impeller 100 of the present disclosure, sucking fluid from the tubular inlet port 104 in an axial direction of the rotation axis of the impeller 100, delaying flow separation of the fluid from the suction surfaces of the blades until a higher pressure gradient is generated across the flow passage 130 by partially covering or reducing an area of the flow passage 130 where the separation is occurring by the curved shape of the suction surface 120, and discharging the sucked fluid in a radial direction of the rotation axis of the impeller 100 through the flow passage 130 to the outer circumference of the ring-shaped shroud 102.

FIG. 7 is a cross-sectional view of the impeller 100 according to one embodiment of the present disclosure, taken in a plane perpendicular to the base plate 101 of the impeller 100 and at line F-F of FIG. 2 of the present application. A length of the uppermost end 113 of the pressurized surface 110 connected to the shroud 102 in the trailing edge 112 is shorter than a length of the lowermost end 114 of the blade 105 connected to the base plate 101.

Figure 8:
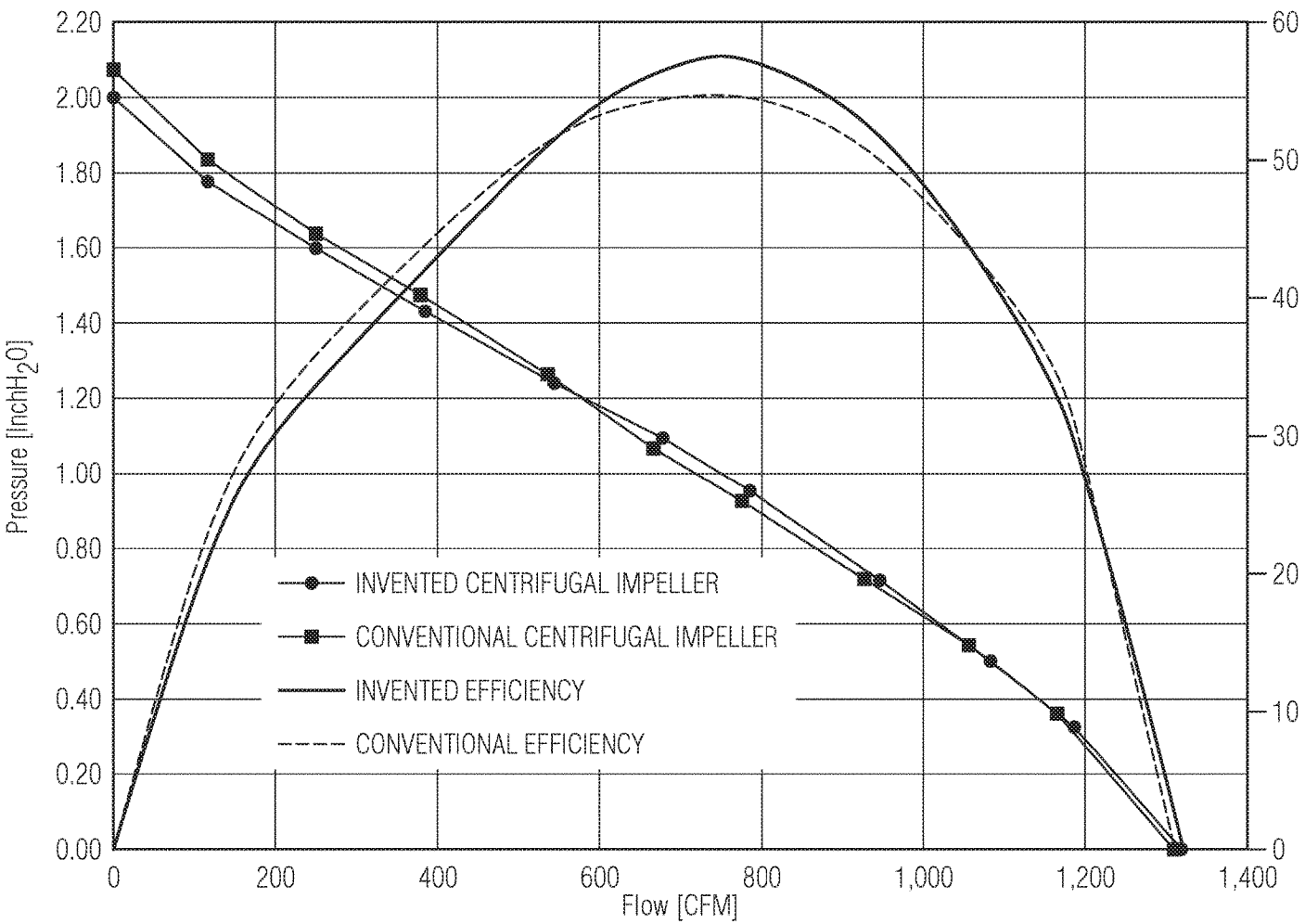
FIG. 8 is a graph that illustrates performance results, P-Q characteristics, and energy efficiency of the impeller according to one embodiment of the present disclosure.

FIG. 8 is a graph that illustrates performance results, the P-Q characteristics, and fan efficiencies of two impeller structures. The invented centrifugal impeller is structured and manufactured according to the embodiments of the present disclosure, while the conventional centrifugal impeller corresponds to a conventional impeller. In FIG. 8, the graph shows the static pressure (in units of inches of water) along the left-side vertical axis, percent fan efficiency along the right-side vertical axis, and (volume) flow rate (in units of cubic feet per minute) along the lower horizontal axis.

As shown in FIG. 8, the impeller structure of the present disclosure shows higher fan efficiency over the range of the operating volume flow rate Q. In order to improve its fan efficiency, the air power of the impeller structure is improved by delaying separation of fluid. The unique structure of the suction surface 120 contributes to the delaying of the fluid separation from the blades 105. With the unique configuration of the suction surface 120, the impeller structure of the present disclosure achieved 57-58% fan efficiency. Moreover, an acoustic noise of the impeller structure of the present disclosure is lower than an acoustic noise of a conventional impeller structure by 1-2 dbA. The fan efficiency is defined as following:

Eff (%)=Air power/Input Power,

Where Air power is a product of Flow rate and Static pressure, i.e., Air power (W)=Flow rate (m^3/s)×Static pressure (pa).

Input Power is an electric power (W)=Voltage (V)× Current (A).

The results of the fan efficiency test of the impeller structure of the present disclosure are described in Table 1 as a specific example. The results of the fan efficiency test of a conventional impeller structure are described in Table 2 as a specific example.

As shown in this graph, the fan efficiency is increased about 3-4% in the impeller structure of the present disclosure in the range of the volume flow rate Q, and the airflow is smoother than that of the conventional impeller. It should be noted that although higher static pressure P is observed when the volume flow rate Q decreases, no significant differences is observed between the static pressure P of both impeller structures.

TABLE 1

| Flow (CFM) | S-Pressure (In-H2O) | Speed (rpm) | Current (A) | Power (W) | Invented Efficiency (%) |
|---|---|---|---|---|---|
| 0 | 1.992 | 2094 | 1.986 | 95.2 | 0 |
| 121 | 1.777 | 2027 | 2.424 | 116.1 | 21.77 |
| 254.3 | 1.604 | 1958 | 2.943 | 140.8 | 34.04 |
| 387.4 | 1.429 | 1891 | 3.213 | 153.7 | 42.32 |
| 546.8 | 1.238 | 1793 | 3.22 | 153.9 | 51.7 |
| 679.2 | 1.091 | 1739 | 3.221 | 153.9 | 56.58 |
| 788.9 | 0.949 | 1744 | 3.219 | 153.8 | 57.2 |
| 947.5 | 0.714 | 1800 | 3.215 | 153.7 | 51.73 |
| 1084.2 | 0.498 | 1818 | 3.22 | 153.9 | 41.23 |
| 1188.4 | 0.322 | 1875 | 3.213 | 153.7 | 29.29 |
| 1321 | 0 | 1960 | 2.986 | 142.88 | 0 |

TABLE 2

| Flow (CFM) | S-Pressure (In-H2O) | Speed (rpm) | Current (A) | Power (W) | Conventional Efficiency (%) |
|---|---|---|---|---|---|
| 0 | 2.071 | 2105 | 1.835 | 88 | 0 |
| 119.4 | 1.83 | 2039 | 2.308 | 110.7 | 23.19 |
| 250.6 | 1.634 | 1968 | 2.821 | 135.2 | 35.58 |
| 380.9 | 1.472 | 1923 | 3.162 | 151.6 | 43.47 |
| 537.5 | 1.263 | 1822 | 3.208 | 153.8 | 51.86 |
| 669.1 | 1.065 | 1783 | 3.209 | 154.4 | 54.22 |
| 777.5 | 0.923 | 1786 | 3.214 | 154.4 | 54.62 |
| 930.5 | 0.718 | 1833 | 3.218 | 154.3 | 50.89 |
| 1058 | 0.539 | 1901 | 3.214 | 154.8 | 43.27 |
| 1168.5 | 0.354 | 1940 | 3.035 | 147.5 | 32.95 |
| 1311.7 | 0 | 2003 | 2.563 | 122.95 | 0 |

FIG. 9 illustrates a perspective view of an impeller 100 for a centrifugal fan according to one embodiment of the present disclosure that includes a shroud 102 with a ring-shaped flat surface. As shown in FIG. 9, the shroud 102 for the present disclosure can have a flat ring-shaped surface. Where the shroud 102 has a flat surface, it is understood that the blades may be hollow, partially hollow, or solid.

It should be evident that this disclosure is by way of example and that various changes can be made by adding, modifying or eliminating details without departing from the fair scope of the teaching contained in this disclosure. The disclosure is therefore not limited to particular details of this disclosure except to the extent that the following claims are necessarily so limited.

What is claimed is:

1. An impeller for a fan, the impeller comprising:

a base plate;

a ring-shaped shroud located above the base plate at a predetermined distance, the shroud comprising a circular inlet in the center of the ring-shape;

a tubular inlet port connecting the circular inlet of the shroud and the base plate;

a plurality of blades annularly disposed around the tubular inlet port at regular intervals between the shroud and the base plate, and connecting the shroud to the base plate; and a flow passage between two of the plurality of the blades that are adjacent to each other in a circumferential direction of the ring-shaped shroud, the flow passage being defined by the base plate, the ring-shaped shroud, and said two of the plurality of the blades, the flow passage defining a fluid outlet from the tubular inlet port through a trailing edge of the plurality of the blades to an outer circumference of the ring-shaped shroud, wherein each of the plurality of the blades comprises:

a pressurized surface extending from a leading edge of each of the plurality of the blades to a trailing edge of each of the plurality of the blades connecting the shroud and the base plate, a cross-section of the pressurized surface having a curved shape expanding toward the pressurized side of each of said blade when viewed in a direction parallel to a rotation axis of the impeller; and a suction surface extending from the leading edge of each of the plurality of the blades to the trailing edge of each of the plurality of the blades connecting the shroud and the base plate with a piecewise smooth curve, a cross-section of the suction surface having a curved shape expanding toward the pressurized side of each of said blade when viewed in the direction parallel to the rotation axis of the impeller, wherein when viewed in the direction parallel to the rotation axis of the impeller, a distance between the pressurized surface and the suction surface of each of the plurality of the blades becomes increasingly larger starting at a predetermined distance from the leading edge of the pressurized surface and extending toward the trailing edge of each of the plurality of the blades, and the distance becomes the largest at the trailing edge of each of the plurality of the blades.

2. The impeller according to claim 1, wherein when viewed in the direction parallel to the rotation axis of the impeller, the curved shape of a cross-section of a pressurized surface of the uppermost end overlaps a cross-section of a pressurized surface of the lowermost end of each of the plurality of the blades.

3. The impeller according to claim 2, wherein the distance between the pressurized surface and the suction surface of each of the plurality of the blades becomes increasing larger at a predetermined height from the lowermost end of each of the plurality of the blades.

4. The impeller according to claim 3, wherein the predetermined height is 50% of the total height of each of the plurality of the blades from the lowermost end to the uppermost end of each of the plurality of the blades.

5. The impeller according to claim 2, wherein when viewed in the direction parallel to the rotation axis of the impeller, the distance between the pressurized surface and the suction surface becomes larger starting at the predetermined distance from the leading edge of the suction surface toward the trailing edge of each of the plurality of the blades at a predetermined height from the lowermost end of each of the plurality of the blades.

6. The impeller according to claim 2, wherein when viewed in the direction parallel to the rotation axis of the impeller, the distance between the pressurized surface and the suction surface becomes larger starting at 10% of a chord length connecting the leading edge and the trailing edge of the blade from the leading edge toward the trailing edge of each of the plurality of the blades at a predetermined height from the lowermost end of each of the plurality of the blades.

7. The impeller according to claim 2, wherein when viewed in the direction parallel to the rotation axis of the impeller, the distance between the pressurized surface and the suction surface becomes larger starting at 15% of a chord length of a suction profile from the leading edge toward the trailing edge of each of the plurality of the blades at a predetermined height from the lowermost end of each of the plurality of the blades.

8. The impeller according to claim 2, wherein when viewed in the direction parallel to the rotation axis of the impeller, the distance between the pressurized surface and the suction surface becomes larger starting at about 1-3% from the leading edge of a chord connecting the leading edge and the trailing edge of each of the plurality of the blades at a predetermined height from the lowermost end of each of the plurality of the blades.

9. The impeller according to claim 2, wherein when viewed in the direction parallel to the rotation axis of the impeller, the distance of the suction surface from the pressurized surface becomes larger starting from the leading edge of the pressurized surface toward the trailing edge of each of the plurality of the blades at a predetermined height from the lowermost end of each of the plurality of the blades.

10. The impeller according to claim 2, wherein when viewed in the direction parallel to the rotation axis of the impeller, the distance between the pressurized surface and the suction surface at the uppermost end and at the leading edge of each of the plurality of the blades is smaller than the distance between the pressurized surface and the suction surface at the uppermost end and the trailing edge of each of the plurality of the blades.

11. The impeller according to claim 2, wherein the uppermost end of the suction surface of one of the plurality of the blades is in direct contact with an uppermost end of a pressurized surface of another of the plurality of the blades that is located next to the one of the plurality of the blades.

12. The impeller according to claim 2, wherein viewed in the direction parallel to the rotation axis of the impeller, the distance between the pressurized surface and the suction surface becomes larger along the suction surface from the leading edge toward the trailing edge of each of the plurality of the blades at a predetermined height from the base plate toward the uppermost end of each of the plurality of the blades, and the distance between the pressurized surface and the suction surface is maximum at the uppermost end of each of the plurality of the blades.

13. The impeller according to claim 2, wherein viewed in the direction parallel to the rotation axis of the impeller, the distance between the pressurized surface and the suction surface becomes larger along the suction surface from the leading edge toward the trailing edge of each of the plurality of the blades starting at a predetermined height from the base plate toward the uppermost end of each of the plurality of the blades, and an angle between a chord of the pressurized surface connecting the leading edge of each of the plurality of the blades and a trailing edge of the pressurized surface and a chord of the suction surface connecting the leading edge of each of the plurality of the blades and a trailing edge of the suction surface at the uppermost end of each of the plurality of the blades is 40-70 degree.

14. The impeller according to claim 2, wherein viewed in the direction parallel to the rotation axis of the impeller, a curvature radius of the curved shape of the pressurized surface is substantially the same between the uppermost end and a lowermost end of each of the plurality of the blades, a curvature radius of the curved shape of the suction surface is substantially the same as the curvature radius of the curved surface of the pressurized surface at the lowermost end of each of the plurality of the blades, and a curvature radius of a predetermined portion of the suction surface is smaller at a predetermined distance from the leading edge of each of the plurality of the blades than a curvature radius of the pressurized surface at the predetermined distance from the leading edge of each of the plurality of the blades at a predetermined height, the curvature radius of the predetermined portion of the suction surface becomes smaller from the predetermined height of each of the plurality of the blades toward the uppermost end of each of the plurality of the blades.

15. The impeller according to claim 2, wherein the ring-shaped shroud comprises a ring-shaped flat surface.

16. The impeller according to claim 2, wherein each of the plurality of the blades comprises a space between the pressurized surface and the suction surface that is hollow.

17. The impeller according to claim 2, wherein a length of the pressurized surface connected to the shroud at the uppermost end of each of the plurality of the blades is shorter than a length of the pressurized surface connected to the base plate at the lowermost end.

18. The impeller according to claim 1, wherein the ring-shaped shroud comprises the uppermost end of each of the plurality of the blades, a back surface of the suction surface of each of the plurality of the blades, and a hollow gap between the pressurized surface and the suction surface.

19. The impeller according to claim 1, wherein each of the plurality of the blades comprises a space between the pressurized surface and the suction surface that is solid or filled.

20. The impeller according to claim 1, wherein the fan is a centrifugal fan or a diagonal fan.

21. A fan comprising:

a drive mechanism; and an impeller, the impeller comprising:

a base plate;

a ring-shaped shroud located above the base plate at a predetermined distance, the shroud comprising a circular inlet in the center of the ring-shape;

a tubular inlet port connecting the circular inlet of the shroud and the base plate;

a plurality of blades annularly disposed around the tubular inlet port at regular intervals between the shroud and the base plate, and connecting the shroud to the base plate; and a flow passage between two of the plurality of the blades that are adjacent to each other in a circumferential direction of the ring-shaped shroud, the flow passage being defined by the base plate, the ring-shaped shroud, and said two of the plurality of the blades, the flow passage defining a fluid outlet from the tubular inlet port through a trailing edge of the plurality of the blades to an outer circumference of the ring-shaped shroud, wherein each of the plurality of the blades comprises:

a pressurized surface extending from a leading edge of each of the plurality of the blades to a trailing edge of each of the plurality of the blades connecting the shroud and the base plate, a cross-section of the pressurized surface having a curved shape expanding toward the pressurized side of each of said blade when viewed in a direction parallel to a rotation axis of the impeller; and a suction surface extending from the leading edge of each of the plurality of the blades to the trailing edge of each of the plurality of the blades connecting the shroud and the base plate with a piecewise smooth curve, a cross-section of the suction surface having a curved shape expanding toward the pressurized side of each of said blade when viewed in the direction parallel to the rotation axis of the impeller, wherein when viewed in the direction parallel to the rotation axis of the impeller, a distance between the pressurized surface and the suction surface of each of the plurality of the blades becomes increasingly larger starting at a predetermined distance from the leading edge of the pressurized surface and extending toward the trailing edge of each of the plurality of the blades, and the distance becomes the largest at the trailing edge of each of the plurality of the blades.

22. The fan according to claim 21, wherein the fan is a centrifugal fan or a diagonal fan.

* * * * *